United States Patent [19]

Luchsinger et al.

[11] 4,026,531

[45] May 31, 1977

[54] PHOTOGRAPHIC CHEMICAL LIQUID AGITATOR

[76] Inventors: Charles R. Luchsinger, 14 Briarwood Drive, Glen Cove, N.Y. 11542; John Joslyn, Bayview Ave., Sag Harbor, N.Y. 11963

[22] Filed: May 27, 1976

[21] Appl. No.: 690,825

Related U.S. Application Data

[63] Continuation of Ser. No. 542,753, Jan. 21, 1975, abandoned.

[52] U.S. Cl. ..... 259/72; 354/327

[51] Int. Cl.[2] ..... B01F 11/00; G03D 3/04

[58] Field of Search ..... 259/72, 73, 55, 54, 259/48, 12, 29; 354/328, 327, 351, 312; 134/187, 188

[56] References Cited

UNITED STATES PATENTS

| | | | |
|---|---|---|---|
| 2,384,898 | 9/1945 | Dietert | 354/327 |
| 3,504,783 | 4/1970 | Kuschnereit | 259/72 |
| 3,587,193 | 6/1971 | Lewis | 259/72 |

FOREIGN PATENTS OR APPLICATIONS

| | | | |
|---|---|---|---|
| 43,046 | 9/1917 | Sweden | 259/73 |

*Primary Examiner*—Robert W. Jenkins
*Attorney, Agent, or Firm*—Arthur A. March

[57] ABSTRACT

A tray container for liquid chemical compositions such as those used in developing photographs or pictures, is pivotally carried on a support for tilting or rocking movement. A spring biased support means is disposed under one end of the tray and a motor driven movable cam is located under the other end. The tray is tilted at one end when engaged by the cam surface and the other end thereupon compresses the spring. When the cam surface becomes disengaged from the tray, the spring is relieved and returns the other end of the tray to its initial position with a jar or snap action, thereby agitating the liquid chemical in the tray.

8 Claims, 7 Drawing Figures

PHOTOGRAPHIC CHEMICAL LIQUID AGITATOR

This is a continuation of application Ser. No. 542,753 filed on Jan. 21, 1975, now abandoned.

BACKGROUND OF THE INVENTION

This invention relates to the field of liguid agitation and particularly to the agitation required in connection with the development of photographs.

Heretofore, there have been several proposals to provide for movement of a container having liquid chemical to achieve movement of the liquid or by mixing devices. These have been provided in an effort to replace the tedious manually operated method used for such movement. However, these proposals have fallen far short of the desired results in that there was no provision for the required action necessary for the development process and the devices were expensive and difficult to manipulate. There has therefore been a need for an agitator particularly for photographic development work which would free the operator accomplishing the development for the performance of other chores while nevertheless providing a fully automated agitation having all the desirable attributes of time and motion to accomplish a true complete photograph.

SUMMARY OF THE INVENTION

The present invention provides a unique and novel liquid chemical agitator which is relatively inexpensive to produce but nonetheless, operates in a completely workmanlike and efficient manner for the development of photographs or pictures. The invention comprises a tray which may either be in the form of a carrier for a container holding the photographic liquid chemical developing fluid or be the actual container itself. The tray is mounted on a support provided with an axle extending beneath the central portion of the tray for producing a pivoting rocker movement of the tray on a relatively horizontal plane. Thus, the tray may be tilted from one side to the other so the other so that the liquid chemical carried therby will be agitated by the movement of the tray itself. A spring biased support is provided under one end of the tray. The spring support preferably comprises a block contacting the underside of the tray. The block has a slot accommodating a post and a leg support. Around the post below the shoulder provided by the block is a spring, preferably in coil form so that the block is normally urged upwardly against the underside of the tray. At the other end of the tray, for movement, a relatively inexpensive motor of small horsepower is provided. The motor rotates a shaft or rod which is provided at its extremity with a cam arrangement in the form of two pins each of which are adapted to engage the underside of the tray opposite the spring biased support. As the shaft carried by the motor rotates, the pibs are moved in a clockwise direction so that one engages the underside of the tray and moves it upwardly tilting the tray against the action of the spring at the other end. When the pin becomes disengaged from the underside of the tray the normal action of the spring becomes effective and the tray is moved with a jarring or snap action, causing a jarring wave-like motion in the tray. This action is repeated when the other pin of the cam arrangement engages the underside of the tray, lifts it upwardly again tilting the tray against the action of the spring before it is released for the same jarring action as above described.

The motor may be either electrically powered or conventional spring-wound motor which is adapted for a relatively long winding down period. Thus, it is merely necessary to place the photo in the chemical developing liquid in the tray, start the motor and the development action of the liquid will then automatically continue while the motor runs down to produce the desired results without the presence of the operator at any time during the developing process.

As set forth in the accompanying specification taking into conjunction with the drawings a specific embodiment of the invention is set forth but this illustration is not at all to be construed as limiting in any way but is merely illustrative of one form of the invention.

BRIEF DESCRIPTION OF THE DRAWINGS

The invention will be further described in connection with the drawings in which.

Figure 1:
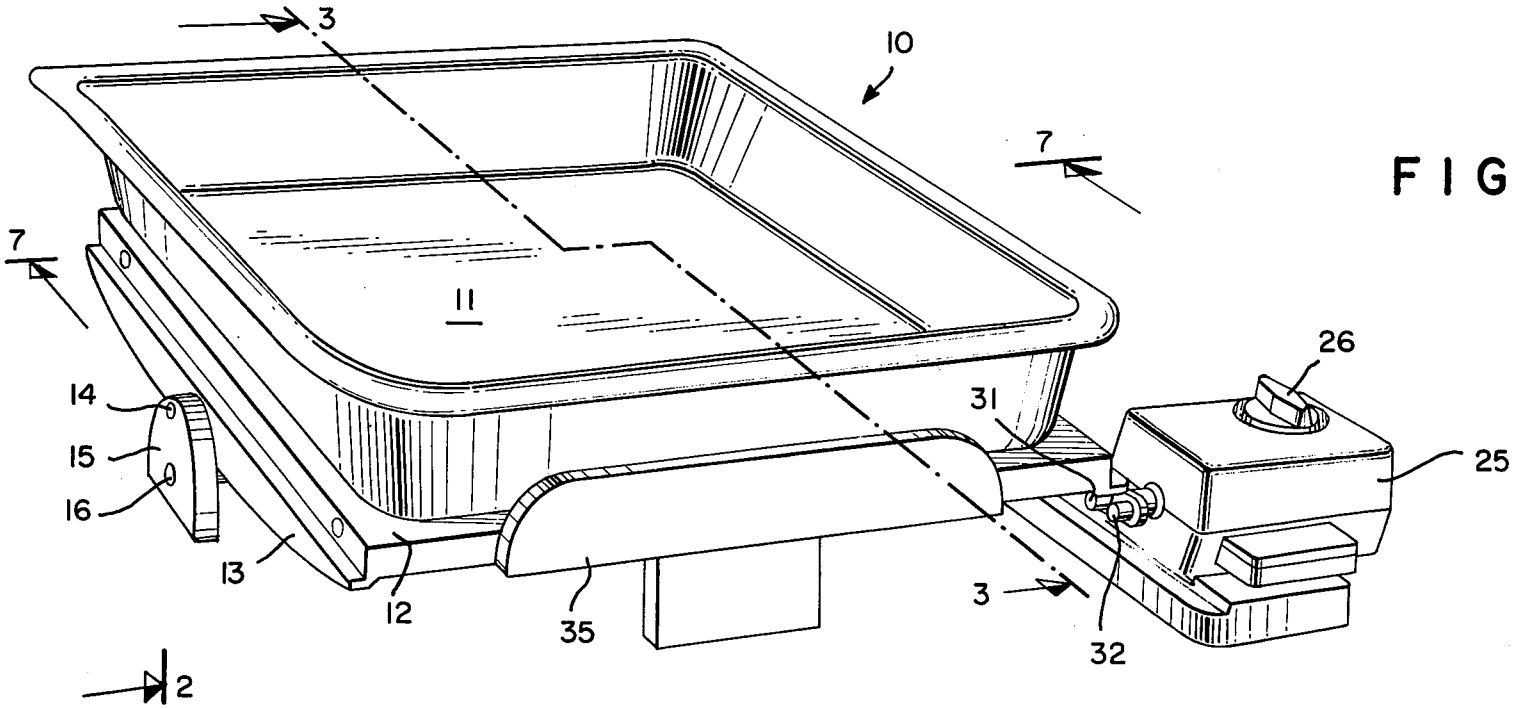
FIG. 1 is a perspective view of the photographic liquid agitator of the present invention in assembled form.

Referring specifically to the drawings there is shown a liquid agitating device 10 which comprises a container 11 carried by a tray support 12. At the outset, it must be understood that while the container 11 and the tray 12 are shown as separate units, the tray, if desired, may be so formed as to be the container itself in one unit. Thus the illustrated two unit form is merely for illustrative purposes and to show that the container 11 may be easily removed from the remainder of the device.

The tray 12 has a U-shaped base 13 for the purposes hereinafter set forth. The tray is pivotably carried by an axle 14 extending to supports 15 on both sides of the tray. The supports 15 are joined and maintained in position by a connecting rod 16 extending under the tray 12 as shown. The supports, as shown, are preferably disposed slightly off center of the length of the tray for the purposes hereinafter set forth.

A spring biased stand support 17 is provided to engage the underside at one end 18 of the movable tray. The stand comprises a block 19 carrying a rod 20 with a recess or slot. A supporting leg 21 is at the end of the rod. A coil spring 22 is disposed around the rod 20 between the block 19 and leg 21. The coil spring engages the shoulder of the block 19 as shown. The spring is normally biased to maintain the tray in a substantially horizontal position.

In accordance with the present invention, a motor 25 is located at the end of the device opposite the spring biased support 17. While the motor may be driven electrically or by any other means, it has been found that an inexpensive spring operated wind-up motor of well known construction may be effectively utilized.

Figure 3:
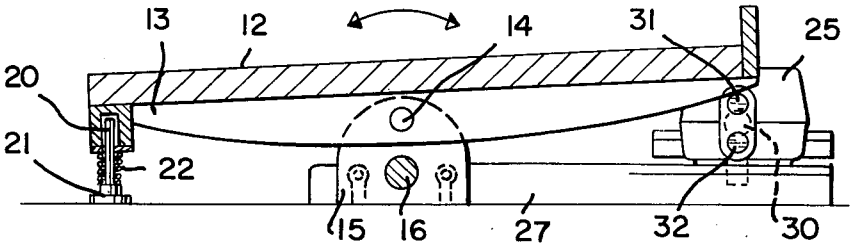
FIG. 3 is a section taken along the lines 3—3 of FIG. 1.
Figure 4:
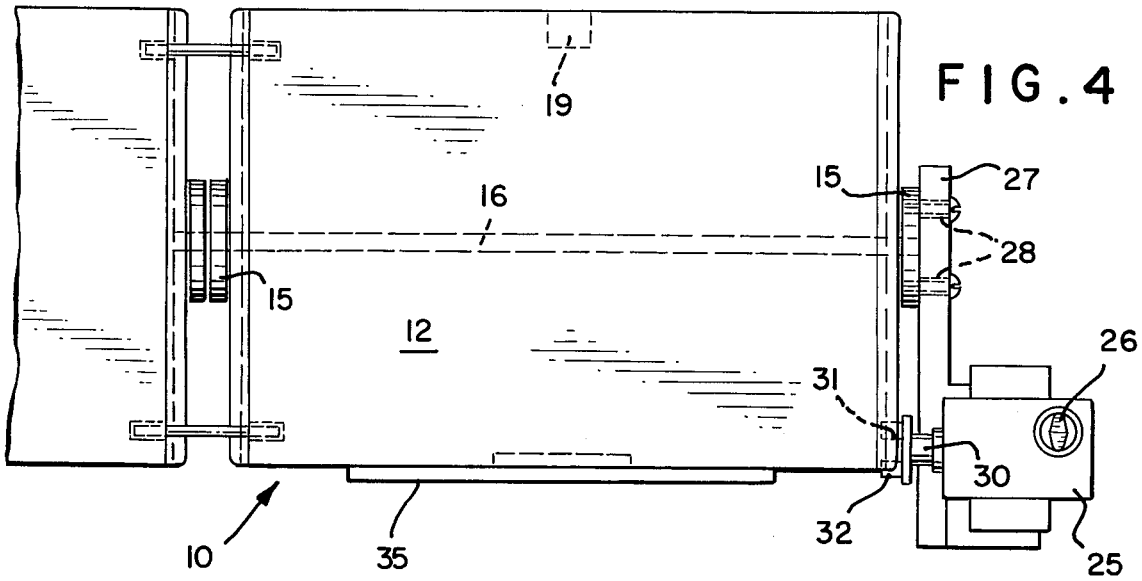
FIG. 4 is a top plan view of the liquid agitator of the present invention.
Figure 5:
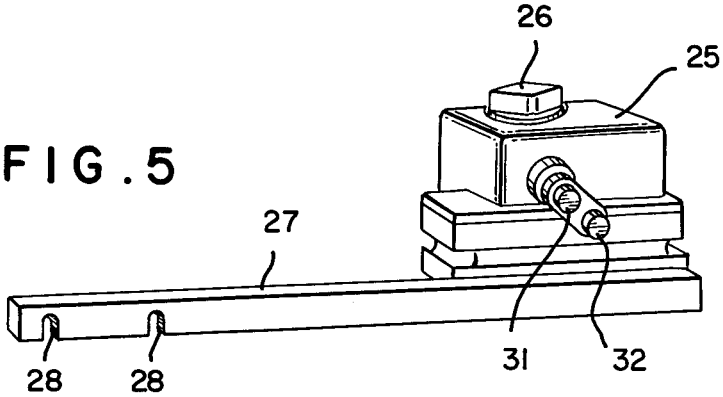
FIG. 5 is a perspective view of the driving motor arrangement for agitating the tray in accordance with the present invention.
Figure 6:
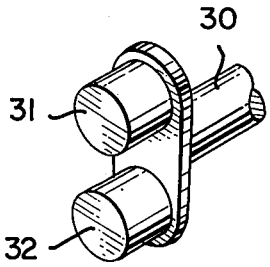
FIG. 6 is a partially broken perspective view of the cam arrangement for agitating the tray in accordance with the present invention.
Figure 7:
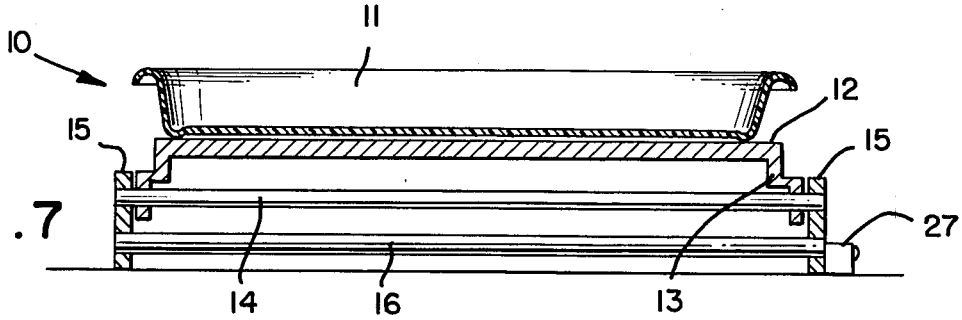
FIG. 7 is a section taken along the lines 7—7 of FIG. 4.

This motor has approximatey a 10 minute wind down time which is sufficient for the purposes of the agitator of the present invention. As shown the motor 25 has a wind up key 26 for activating purposes and the motor may be connected to one of the supports 15 by means of an arm 27 which is provided with nothces 28 to fit around the attachment screws provided at that support 15 and maintain the motor in position and prevent any inadvertent lateral movement (see FIG. 4). This arrangement maintains the parts in appropriate position during the operation of the device without such ports moving relative to each other. A shaft or rod 30 carried by the motor 25 is rotatable in a clockwise direction, e.g. as viewed in FIG. 3. The rod has a plate carrying two pins, 31 and 32, which effectively act in combination as a cam arrangement having extending surfaces and flats. The tray 12 is provided with a stop support 35, as shown, which limits the movement of the tray upon its return to horizontal position during the operation hereinafter described.

In operation, the device of the present invention provides a snap motion by which the liquid chemical within the tray or container is moved most appropriately and efficiently as is required for the development of pictures or photos. This is accomplished as follows: The motor 25 is activated by winding the spring through key 26. The rod or shaft 30 begins to rotate causing movement of the pin 31 in a clockwise direction. The upward movement of the pin causes the tray 12 and container 11 to be tilted from its horizontal position shown in FIG. 1 to the position shown in FIG. 2, wherein the tray 12 and container 11 are sloped and the spring 22 is compressed. Further clockwise movement of the pin 31 causes it to become disengaged from the underside of the tray and the pressure on the tray is released. The spring 22, which as shown in FIG. 2 has been under compression as aforesaid, is consequently released and the block 19 moving by the action of the spring thrusts against the underside end 18 of the tray with a jarring or snap action, i.e. an abrupt return motion, causing the liquid chemical in the tray to slosh to exactly the appropriate degree to provide effective movement of the photographic solution over the photograph in the developing process.

The supports 15 are preferably somewhat of center of the length of the tray 12. This inherent offset pivot lever arrangement, it will be understood, enhances the jarring or snap action of the tray upon its abrupt return to horizontal position against the action of stop support 35.

Figure 2:
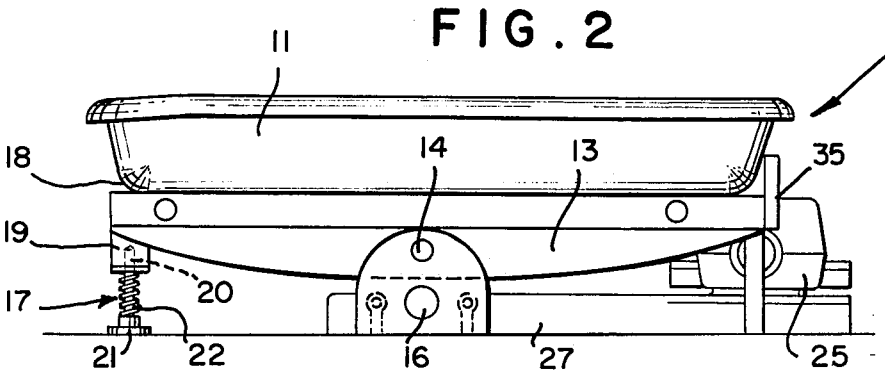
FIG. 2 is a section taken along the lines 2—2 of FIG. 1.

The shaft 30, of course, continues to rotate and, in the following sequential operation, the pin 32 moves in a clockwise direction engaging the underside of the tray 12 and again causing the tilting movement as shown in FIG. 2. The entire sequence is then repeated. As set forth this movement will continue while the motor winds down or if an electric motor is utilized until the motor is switched off. However, during the operation there need be no attendant present and the attendant is thus released for other functions. Furthermore, the parts can be so arranged as to placement and size as to prevent any spillage of the liquid solution from the tray or container and to receive just the appropriate amount of jarring action for the effective photographic development. In addition this arrangement provides for a repeating snap or jarring action of exactly the same magnitude in each instance without requiring any compensation for human variances or the like. As a consequence, a very efficient automatic liquid chemical agitator has been provided by the present invention.

The scope of the invention is not to be contrued as being limited by the illustrative description and drawings which merely display one embodiment but, instead, the scope is as described in the appended claims.

What is claimed is:

1. A liquid agitator for photographic development or the like comprising:

a normally substantially horizontally disposed tray for carrying said liquid;

means for tilting said tray from the normally substantially horizontally disposed position thereof; and means for returning said tray to said normally substantially horizontally disposed position with an abrupt return motion jarring snap action to thereby slosh and agitate the liquid, said means for returning said tray being operable to return said tray freely and independently of the influence of said means for tilting said tray.

2. The liquid agitator of claim 1 including a container located on said tray in which the liquid is contained.

3. The liquid agitator of claim 1 in which the means for tilting the tray comprises a motor driven cam.

4. The liquid agitator of claim 1 in which the means for returning the tray to said normally substantially horizontally disposed position comprises a spring biased support.

5. The liquid agitator of claim 1 in which the means for tilting the tray comprises two movable pins which alternately engage and disengage said tray in sequential fashion as said pins are moved.

6. The invention as defined in claim 1 including a stop for preventing the tray from movement beyond said normally substantially horizontally disposed position when it is returned with said jarring snap action.

7. A liquid agitator for photographic development or the like comprising:

a normally substantially horizontally disposed tray;

a container carried by said tray;

movable means for tilting said tray from the normally substantially horizontally disposed position thereof comprising two movable pins sequentially engaging and disengaging under one end of said tray;

spring biased means under the other end of said tray being compressed when said tray is tilted and returning to its normal state when said tray is returned to its normally substantially horizontally disposed position with an abrupt return motion jarring snap action to thereby slosh and agitate the liquid, said spring biased means being operable to return said tray freely and independently of said movable means for tilting said tray; and a stop for preventing the tray from movement beyond said normally substantially horizontally disposed position when it is returned with said jarring snap action.

8. A method for agitating liquid for photographic development statically disposed in a flat container carried on a normally substantially horizontally disposed tray including the steps of tilting said tray carrying said container with the liquid from the normally substantially horizontally disposed postition thereof and thereafter freely and independently returning said tray and container to said normally substantially horizontally disposed position with an abrupt return motion jarring snap action to thereby slosh and agitate the liquid in the container.

* * * * *